US006793101B2

(12) United States Patent
Shinozaki et al.

(10) Patent No.: US 6,793,101 B2
(45) Date of Patent: Sep. 21, 2004

(54) SYNTHETIC RESIN BOTTLE CAP UNIT

(75) Inventors: Natuo Shinozaki, Koto-ku (JP); Masaru Tamura, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 153 days.

(21) Appl. No.: 10/296,923

(22) PCT Filed: Dec. 19, 2001

(86) PCT No.: PCT/JP01/11124

§ 371 (c)(1),
(2), (4) Date: Nov. 29, 2002

(87) PCT Pub. No.: WO02/49929

PCT Pub. Date: Jun. 27, 2002

(65) Prior Publication Data

US 2004/0020943 A1 Feb. 5, 2004

(51) Int. Cl.[7] ..... B67D 5/00

(52) U.S. Cl. ..... 222/153.02; 222/153.07; 222/153.14; 222/541.5; 222/541.9; 222/547; 215/252; 215/256

(58) Field of Search ..... 222/153.01, 153.02, 222/153.03, 153.05, 153.06, 153.07, 153.09, 153.1, 153.14, 541.5, 541.6, 541.7, 547; 220/265, 266, 270, 276; 215/250, 252, 256

(56) References Cited

U.S. PATENT DOCUMENTS 3,160,327 A * 12/1964 Porcelli ..... 222/153.07
4,264,022 A * 4/1981 Perne et al. ..... 222/547
4,279,353 A * 7/1981 Honma ..... 215/254
5,725,115 A * 3/1998 Bosl et al. ..... 215/252

* cited by examiner

*Primary Examiner*—Gene Mancene
*Assistant Examiner*—Patrick Buechner
(74) *Attorney, Agent, or Firm*—Oliff & Berridge, PLC

(57) ABSTRACT

The bottle cap unit (1) of this invention comprises an inner cap (2), which is tightly fitted to the bottleneck (24) to form a pour spout, and an outer cap (15), which is detachably screwed on or off the inner cap (2) to close or open the pour spout. The first locking part (5) is disposed on the outer wall of the attaching cylinder (3) of the inner cap (2). The second locking part (23) is disposed on the locking cylinder (22), which is connected to the outer cylinder (20) of the outer cap (15) via the breaking pieces (21). This second locking part (23) is engaged from underside with the first locking part (5) to lock the outer cap (15). The attachment of the inner cap (2) to the bottleneck (24) is set at such a strength that allows the inner cap (2) to be manually snapped out of the bottleneck (24). In this configuration, the bottle cap unit (1) can be easily snapped out of the bottleneck (24) for separate collection.

13 Claims, 14 Drawing Sheets

SYNTHETIC RESIN BOTTLE CAP UNIT

TECHNICAL FIELD

This invention refers to a synthetic resin bottle cap unit having a tamperproof function, which comprises an inner cap, fitted to the bottleneck and provided with a pour spout for the liquid content, and an outer cap to open or close the pour spout of this inner cap, wherein the bottle cap unit is configured so that separate collection is advantageously carried out at the time of waste disposal.

BACKGROUND OF THE INVENTION

There is a need for separately collecting synthetic resin products for efficient reutilization of discarded synthetic resin bottles and containers. As a means of such separate collection, there is a prior-art technology disclosed in the Official Gazette of Japanese patent application laid open No. 1999-255251, which refers to a bottle cap fitted to the neck of a bottle or container to form a pour spout and which shows a mechanism that enables the bottle cap to be readily removed from the bottle when it is discarded.

The bottle cap of that prior-art invention comprises an inner cap having an attaching cylinder, which is tightly fitted around the bottleneck and locked by climbing over the neck to form a pour spout, and an outer cap, which is detachably screwed on or off the inner cap to close or open the pour spout. The locking recession corresponding to the first locking part is integrally formed on the outer circumference of the portion having locking engagement with the bottleneck, and this locking recession is disposed on the lower part of the attaching cylinder of the inner cap and is provided with plural, vertical expanding slots. A locking ring having the second locking part is connected via the plural breaking pieces to the lower part of the outer cylinder of the outer cap that is fitted around this attaching cylinder. The second locking part locks with the first locking part of the attaching cylinder in a manner that the second one is unable to climb over the first one in the upward direction but is able to climb over the bottleneck in the downward direction by the forced pulling operation.

In this prior art, tamper-proof action is displayed by the separation of the locking ring from the outer cylinder of the outer cap. The fitting of the inner cap to the bottleneck is tightly maintained by the locking action of the locking ring to lock with the lower portion of the attaching cylinder. The inner cap can be readily removed from the bottleneck by breaking the locking ring away in the downward direction from the lower end of the attaching cylinder.

However, in this prior art, the lower portion of the attaching cylinder of the inner cap is in an exposed state, which has caused a problem in that the inner cap can be easily broken away from the bottleneck by inserting a hard tip of, e.g., a screwdriver, into the gap between the attaching cylinder and the bottleneck and picking the inner cap out of the bottleneck.

It is necessary in this prior art to form both of the portion having a bottleneck-locking function and the locking recession corresponding to the first locking part that locks the outer cap, integrally in the lower portion of the attaching cylinder of the inner cap. This first locking part is engaged with the second locking part so as to hinder the locking ring from rising upward and from moving freely, but to permit the ring to be moved forcibly. Thus, another problem arises here in that the structure becomes all the more complicated.

In addition, after the breaking pieces have been broken, there is no visible change in the relationship of the locking ring with the lower portion of the attaching cylinder because the pieces remain at the same position in the lower portion of the attaching cylinder. Before and after the breakage, there is no change in the position of the locking ring. It is difficult, therefore, to recognize the breakage of the breaking pieces from the looks of them. For this reason, still another problem brought about was that sometimes the tamper-proof effect has not been fully demonstrated.

SUMMARY OF THE INVENTION

This invention has been made to solve these problems found in the above-described prior art. An object of this invention is to make it impossible to break open the inner cap unjustly from the bottleneck by means of a hard tool. Another object is to give the bottle cap unit a simple structure. Still other objects are to demonstrate a clear tamper-proof effect, to enhance the safety of bottles as commercial products, and to reduce the production cost reasonably.

In the first embodiment of this invention, there is provided a synthetic resin bottle cap unit. It comprises an inner cap having an attaching cylinder that is tightly fitted around bottleneck, and locked by climbing over the neck, to form a pour spout. It also comprises a cylindrical, flat-topped, outer cap, which is detachably screwed on or off the inner cap to close or open the pour spout. This attaching cylinder of the inner cap is provided with the first locking part disposed on the outer cylindrical wall of the portion opposed to the bottleneck-locking part. The outer cap is provided with an outer cylinder and a locking cylinder disposed in the lower portion of the outer cylinder and integrally connected thereto through multiple breaking pieces. The locking cylinder has a bore diameter larger than the outer diameter of this neck ring, and is provided with the second locking part that goes into the locking engagement from underside with the first locking part under the condition that the outer cap has been screwed on the bottleneck. In this configuration, attachment of the inner cap to the bottleneck is set at such a strength that the inner cap can be manually snapped out of the bottle neck, and yet that strength is within a range enough to keep the inner cap fitted tightly to the bottleneck but not to allow to inner cap to be slipped out of the bottleneck because of a water-hammer force of the liquid content nor to allow the inner cap to move freely around the bottleneck.

DISCLOSURE OF THE INVENTION

Under the condition that this synthetic resin bottle cap unit has been fitted to the bottleneck, the outer cap closes the pour spout of the inner cap now that the outer cap has been screwed on the inner cap. At that time, the outer cap is fitted around the attaching cylinder of the inner cap, and the locking cylinder allows its second locking part to enter the locking engagement from underside with the first locking part, which is formed on the outer circumference of the attaching cylinder of the inner cap.

When the outer cap is turned in order to screw it off the inner cap, the locking cylinder is unable to ascend because of the locking engagement between the first and second locking parts, unlike the combination of the main cylinder and the outer cylinder of the outer cap, which continues to ascend. As a result, the breaking pieces are broken at one time of this ascent.

Once the breaking pieces have been broken, the locking cylinder falls downward due to its own weight, and its position changes to a large extent before and after the breakage. Because of this large positional change in the locking cylinder, it becomes possible to know clearly that the breaking pieces have been surely broken and to demonstrate the tamper-proof function.

After the breakage, the locking cylinder falls easily and smoothly down to the limit of fall, with no interference from the neck ring because the locking cylinder has a bore diameter larger than the outer diameter of the neck ring.

When the bottle cap unit is separately collected from the bottleneck, the inner cap can be forcibly snapped out of the bottleneck by grasping the inner cap with a hand, acting a wrenching force, and deflecting and deforming the attaching cylinder in the direction in which the diameter is widened.

At that time, if the combination of the main cylinder and the outer cylinder of the outer cap is screwed on the inner cap that has been fitted to the bottleneck, the bottle cap unit can be grasped firmly with a hand under a favorable condition.

After the inner cap has been snapped out of the bottleneck, the locking cylinder is taken out of the bottleneck to complete the separate collection of the bottle cap unit.

Before the breaking pieces are broken, the locking cylinder of the outer cap remains fitted around the attaching cylinder of the inner cap. In this state, the attaching cylinder is inhibited from widening the diameter and deforming the shape. As a result, the inner cap remains fitted stably and firmly to the bottleneck.

In the second embodiment of this invention, there is provided another synthetic resin bottle cap unit. It comprises an inner cap having an attaching cylinder that is tightly fitted around bottleneck, and locked by climbing over the neck, to form a pour spout. It also comprises a cylindrical, flat-topped, outer cap, which is detachably screwed on or off the inner cap to close or open the pour spout. This attaching cylinder of the inner cap is provided with the first locking part disposed on the outer cylindrical wall of the portion opposed to the bottleneck-locking part and also with a hooking edge slightly projected laterally from the lower edge of the attaching cylinder. The outer cap is provided with an outer cylinder and a locking cylinder disposed in the lower portion of the outer cylinder and integrally connected thereto through multiple breaking pieces. The locking cylinder has a bore diameter larger than the outer diameter of this neck ring, and is provided with the second locking part that goes into the locking engagement from underside with the first locking part and also into a light locking engagement from upper side with the hooking edge under the condition that the outer cap has been screwed on the bottleneck. In this configuration, attachment of the inner cap to the attaching cylinder is set at such a strength that the inner cap can be manually snapped out of the bottle neck, and yet that strength is within a range enough to keep the inner cap fitted tightly to the bottleneck but not to allow the inner cap to move freely around the neck.

Once the breaking pieces have been broken, the locking cylinder falls downward due to its own weight until the second locking part is engaged from upper side with the hooking edge of the inner cap, and its position changes to a large extent before and after the breakage. Because of this large positional change in the locking cylinder, it becomes possible to know clearly that the breaking pieces have been surely broken and to demonstrate the tamper-proof function.

Before the breaking pieces are broken, the locking cylinder of the outer cap is fitted around the lower portion of the attaching cylinder of the inner cap. Since, therefore, the attaching cylinder of the inner cap is unable to widen its diameter and deform its shape freely, tight attachment of the inner cap to the bottleneck is stably maintained.

When the bottle cap unit is separately collected from the bottleneck, the inner cap can be forcibly snapped out of the bottleneck by grasping the inner cap with a hand, acting a wrenching force, unlocking the second locking part from the weak locking engagement with the hooking edge, allowing the locking cylinder to fall, and then forcibly wrenching the inner cap away from the bottleneck.

At that time, if the combination of the main cylinder and the outer cylinder of the outer cap is screwed on the inner cap that has been fitted to the bottleneck, the bottle cap unit can be grasped firmly with a hand under a favorable condition.

After the inner cap has been wrenched away, the locking cylinder is taken out of the bottleneck to complete the separate collection of the bottle cap unit.

The third embodiment of this invention includes the configuration of the first or second embodiment, and also comprises that the strength of attachment of the inner cap to the bottleneck is set by means of the thickness of the attaching cylinder of the inner cap.

In this embodiment, the thinner the attaching cylinder of the inner cap is, the more easily it becomes susceptible to deflective deformation by external force in the diameter-widening direction. On the other hand, the thicker the attaching cylinder is, the more difficult it is to deform the attaching cylinder. Thus, by setting this thickness properly, it is possible to set the strength of attachment of the inner cap to the bottleneck within a reasonable range without adding any special structure.

The fourth embodiment of this invention includes the configuration of the first or second embodiment, and also comprises that the strength of attachment of the inner cap to the bottleneck is set by means of the expanding slots disposed at least in the lower portion of the attaching cylinder.

In this embodiment, shape parameters, such as the number of expanding slots and the slot length, determine the extent to which the attaching cylinder is deformed by the deflection caused by an external force. Thus, by using the slot number and length, it is possible to set the strength of attachment of the inner cap to the bottleneck precisely within a reasonable range.

The fifth embodiment of this invention includes the configuration of the first, second, third or fourth embodiment, and also comprises that the locking cylinder of the outer cap has a height ranging from the level of the first locking part to the neck ring of the bottleneck.

Because, in this embodiment, the locking cylinder of the outer cap has a height ranging from the level of the first locking part of the attaching cylinder to the neck ring of the bottleneck, this locking cylinder covers the space between the neck ring of the bottle and the lower edge of the attaching cylinder of the inner cap. This configuration prevents the bottle cap unit from being unjustly picked out of the bottleneck by inserting a hard tool, such as the blade of a screwdriver, into this space.

The sixth embodiment of this invention includes the configuration of the first, second, third, fourth, or fifth embodiment, and also comprises that the first locking part of the inner cap has a simple ridge structure.

In this embodiment, the structure of the first locking part is quite simplified. A major portion of the attachment to the bottleneck has a large thickness all the more because the first locking part is disposed in this portion. This makes serves to lessen the thickness of other portions of the attaching cylinder.

The seventh embodiment of this invention includes the configuration of the first, second, third, fourth, fifth, or sixth embodiment, and also comprises that the second locking part is a circumferential ridge, which is disposed on the inner surface of the locking cylinder of the outer cap and is capable of climbing over the first locking part.

In this embodiment, the second locking part is a circumferential ridge of a simple shape. Because of its simple structure, the bottleneck, the inner cap, and the outer cap can be attached to one another with precision. It becomes easy, therefore, to mold the outer cap, which requires precise molding.

The eighth embodiment of this invention includes the configuration of the first, second, third, fifth, sixth, or seventh embodiment, and also comprises that either or both of the first locking part and the second locking part have an intermittent, circumferential ridge structure.

When, in this embodiment, either or both of the first locking part and the second locking part have an intermittent, circumferential ridge structure, the thick, first or second locking part can be readily expanded in the radial direction. Thus, it becomes easy to attach the inner cap to the bottleneck in the state in which the outer cap has been fitted in advance to the inner cap.

The intermittent, circumferential ridge structure herein refers to a circumferential ridge structure in which the ridge is cut off at two opposite places or at multiple, equally spaced places.

The ninth embodiment of this invention includes the configuration of the first, second, third, fourth, fifth, or sixth embodiment, and also comprises that the second locking part consists of multiple, flexible flaps, which are capable of elastic displacement to extend the flaps obliquely upward and inward from the locking cylinder of the inner cap.

In this embodiment, the second locking part consisting of flexible flaps makes it easy to climb over the first locking part of the inner cap and to enter the locking engagement from underside with the first locking part without giving damage to the breaking pieces that are apt to be broken.

The tenth embodiment of this invention includes the configuration of the first, second, third, fourth, fifth, sixth, seventh, eighth, or ninth embodiment, and also comprises that a space enabling the periphery of a coin to enter therein is formed between the neck ring and the lower edge of the attaching cylinder of the inner cap.

In this embodiment, it is possible even for a weak person to snap the inner cap easily out of the bottleneck at the time of waste disposal, using a hard tool found near at hand, such as a coin.

The eleventh embodiment of this invention includes the configuration of the first, second, third, fourth, fifth, sixth, seventh, eighth, ninth, or tenth embodiment, and also comprises that the minimum bore diameter of the locking cylinder including the second locking part is set at a value larger than the outer diameter of the neck ring of the bottleneck.

In this embodiment, after the breakage of the breaking pieces, the locking cylinder falls down to the limit of fall for a sufficient height without interference of the neck ring. Thus, the tamper-proof function is clearly demonstrated, and this fall definitely exposes the space between the attaching cylinder and the neck ring.

The twelfth embodiment of this invention includes the configuration of the first, second, third, fourth, fifth, sixth, seventh, eighth, ninth, tenth, or eleventh embodiment, and also comprises that the inner cap is colored differently from the outer cap.

In this embodiment, the breaking pieces are broken, and the locking cylinder of the outer cap falls to the limit of fall. In this state, the lower portion of the attaching cylinder of the inner cap having a color different from the color of the outer cap becomes visible beneath the outer cap. This color difference demonstrates the tamper-proof function more effectively.

The thirteenth embodiment of this invention includes the configuration of the first, second, third, fourth, fifth, sixth, seventh, eighth, ninth, tenth, eleventh, or twelfth embodiment, and also comprises that the pour spout of a pull-open type is formed in the inner cap to guide the flow of the liquid content, and is opened by pulling up a pull ring and the like to break and remove a lid portion, with this lid portion being zoned by a breaking groove that forms a closed loop surrounding the sealing lid, which constitutes the bottom of the pour spout.

In this embodiment of this invention, the bottle can be kept sealed securely and firmly until the pour spout is opened.

PREFERRED EMBODIMENTS OF THE INVENTION

Figure 1:
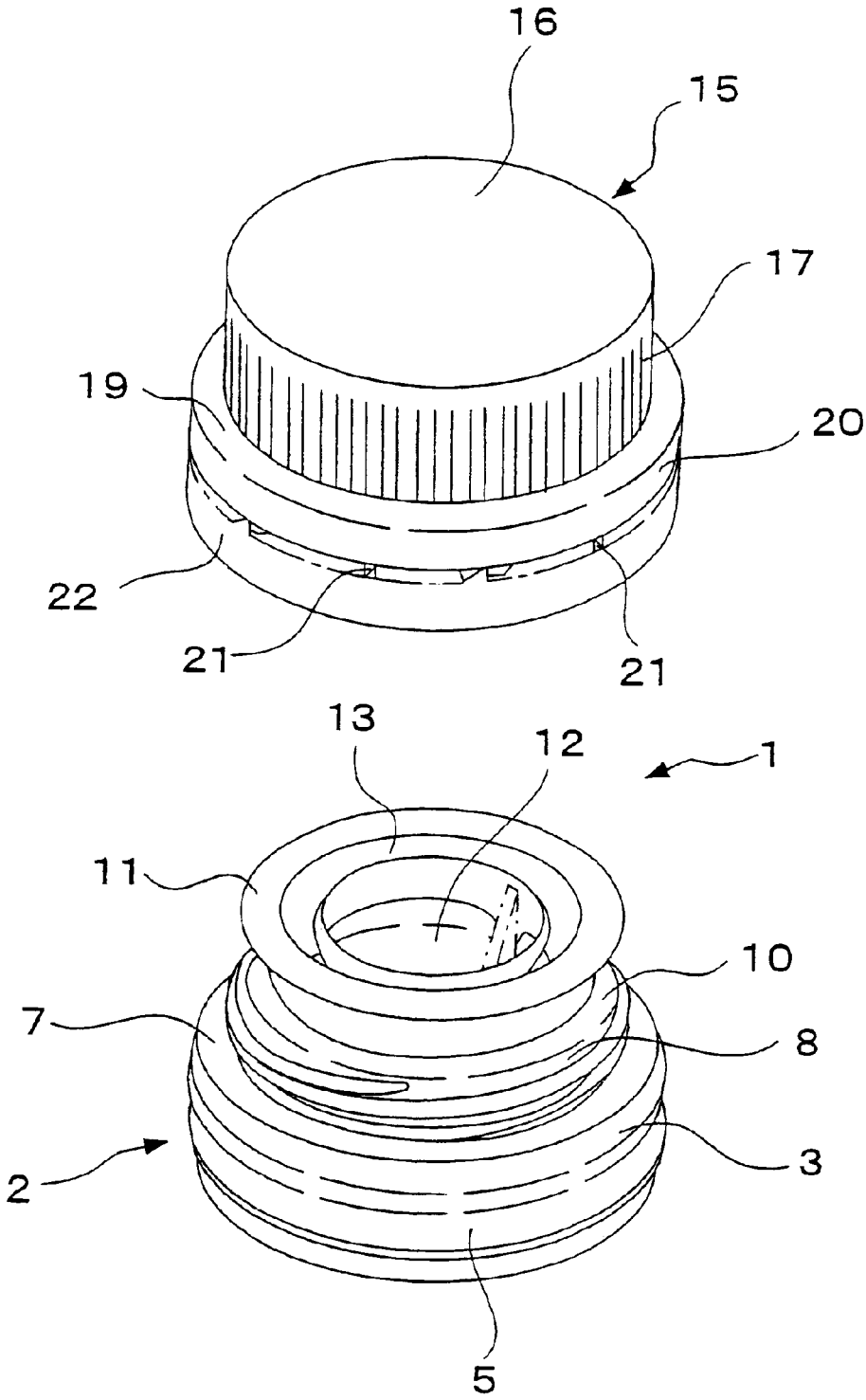
FIG. 1 is an entire perspective view showing the bottle cap unit in the first embodiment of this invention before the unit is assembled.

This invention is further described with respect to preferred embodiments, now referring to the drawings.

First Embodiment

The bottle cap unit 1 of this invention comprises the inner cap 2 and the outer cap 15, both made of a polypropylene resin or a low-density polyethylene resin.

Figure 2:
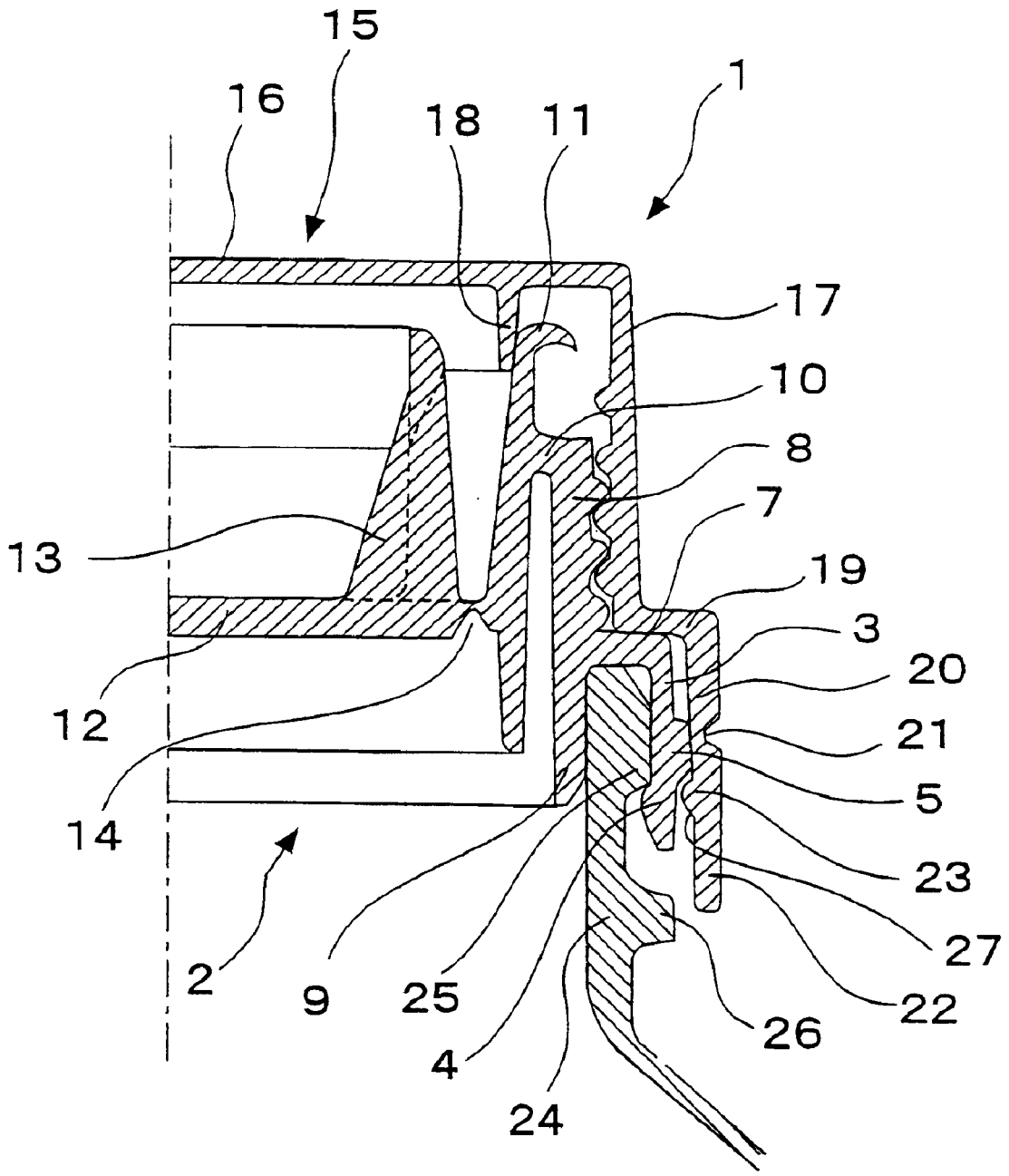
FIG. 2 is a partial, front elevational view showing the right half of the bottle cap unit in the first embodiment of FIG. 1 in a longitudinal section before the outer cap is screwed off.

As shown in FIGS. 1 and 2, the inner cap 2 has a configuration comprising:

the attaching cylinder 3, which is fitted around the bottleneck 24 and is formed at a height that enables the periphery of a coin to enter the gap between the neck ring 26 and the lower portion of this attaching cylinder 3;

the threaded cylinder 8 having a thread ridge notched on the outer wall thereof and standing from the inner ledge 7, which is connected to the upper portion of the attaching cylinder 3;

the pour spout 11 of a bottomed cylindrical shape widened at the top end like a trumpet and connected to the threaded cylinder 8 via inward brim 10; and the lid portion 13 provided with a pull ring and the like and zoned by a breaking groove 14 that forms a closed loop surrounding a sealing lid 12, which constitutes the bottom of the pour spout 11.

The attaching cylinder 3 to be fitted around the bottleneck 24 comprises a portion having a locking function for the bottleneck 24. This portion is represented by a stop ridge 4, which is disposed on the lower inner wall of the attaching cylinder 3 and climbs over the circumferential, bottleneck-locking ridge 25 disposed on the outer wall of the top portion of the bottleneck 24. The first locking part 5 of a circumferential ridge is formed on the outer wall of the attaching cylinder 3 at a position higher than the adjacent stop ridge 4 and at a similar position that the bottleneck-locking ridge 25 takes.

The strength of attachment of the inner cap 2 to the bottleneck 24 is set by means of the thickness of the attaching cylinder 3 at such a level that the inner cap 2 can be manually snapped out of the bottleneck 24 under the condition that the locking cylinder 22 has been detached from the outer cap 15, and yet that strength is within a range enough to keep the inner cap 2 fitted tightly to the bottleneck 24 but not to be slipped out of the bottleneck 24 because of a water-hammer force of the liquid content, not to allow the inner cap 2 to move freely around the neck, and not to be slipped out when the lid portion 13 is broken and removed by pulling up the pull ring. If the stop ridge 4 of the inner cap 2 has an intermittent ridge structure, it is possible to weaken the strength of attachment of the attaching cylinder 3 to the bottleneck 24 so that the inner cap 2 can be snapped out of the bottleneck 24.

Sealing cylinder 9 hanging from the threaded cylinder 8 allows the inner cap 2 to be fitted tightly to the bottleneck 24 by making the bottleneck 24 fitted into the gap between the sealing cylinder 9 and the attaching cylinder 3.

The outer cap 15 has a configuration comprising:

a top plate 16 from which a stopper guide 18 is suspended downward for tight fitting into the pour spout 11;

a main cylinder 17, which is screwed on the threaded cylinder 8 and is suspended from the periphery of the top plate 16;

an outer cylinder 20, which is beneath the main cylinder 17, is fitted around the attaching cylinder 3, and is suspended from the edge of the outward brim 19; and a locking cylinder 22, which is connected to the lower portion of this outer cylinder 20 through multiple, easy-to-break breaking pieces 21 and is provided with a circumferential ridge 27 serving as the second locking part 23, which is disposed on the inner surface of this locking cylinder 22, and is engaged with the first locking part 5 by climbing it over and locking therewith from underside.

If the first locking part 5 of the inner cap 2 has an intermittent, circumferential ridge structure, or if the second locking part 23 of the outer cap 15 has an intermittent, circumferential ridge 27, or both of the first and second locking parts have an intermittent, circumferential ridge structure, then the first locking part 5 of the inner cap 2 or the second locking part 23 of the outer cap 15 is apt to widen the diameter even if it is thick. In such a case, the inner cap 2 can be easily fitted to the bottleneck 24 in the state in which the outer cap 15 has been screwed on the inner cap 2.

The locking cylinder 22 has a minimum bore diameter larger than the outer diameter of the neck ring 26 even if the bore diameter includes the circumferential ridge 27. In the unopened state shown in FIG. 2, the circumferential ridge 27 is contacted with the first locking part 5, and the lower edge of the locking cylinder 22 faces the side of the neck ring 26. When the breaking pieces 21 are broken, the locking cylinder falls downward without interference of the neck ring 26.

In this unopened state, the locking cylinder 22 keeps back the attaching cylinder 3 from outside specifically with the circumferential ridge 27, and thereby prevents the attaching cylinder 3 from indiscriminate outward expansion and deformation, thus achieving and maintaining stable fitting of the inner cap 2 to the bottleneck 24.

The locking cylinder 22 has a height ranging from the level of the first locking part 5 to the neck ring 26, covers the gap formed between the attaching cylinder 3 and the neck ring 26, and thereby makes it impossible to pick the inner cap 2 unjustly out of the bottleneck 24.

Figure 3:
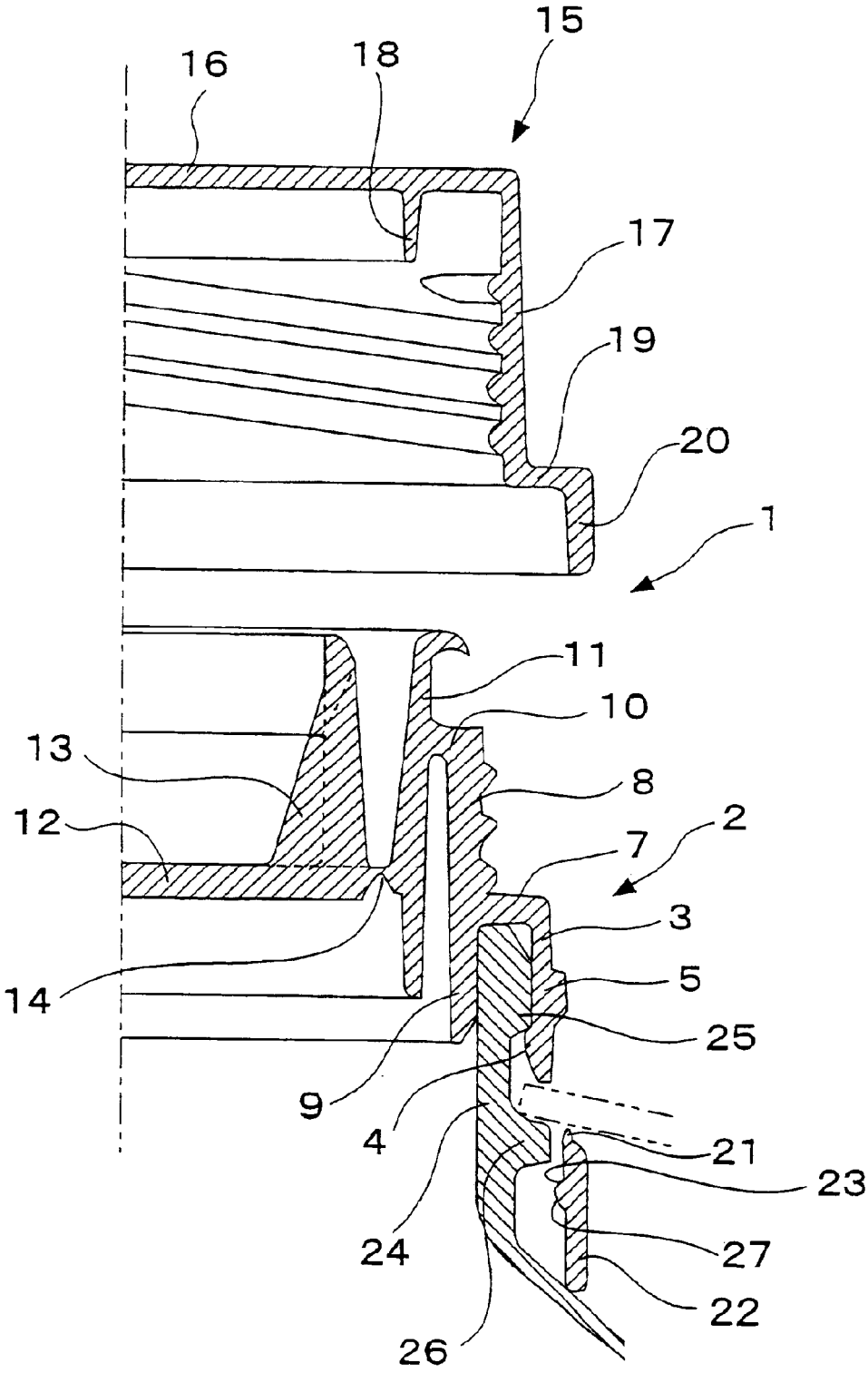
FIG. 3 is a partial, front elevational view showing the right half of the bottle cap unit in the first embodiment of FIG. 1 in a longitudinal section after the outer cap has been screwed off.

As shown in FIG. 3, when the breaking pieces 21 are broken, the locking cylinder 22 falls below the neck ring 26 due to its own weight.

When the liquid content is to be poured out for the first time, the outer cap 15 is screwed off the inner cap 2, and the pull ring is pulled up to break and remove the lid portion 13. The thickness of the attaching cylinder 3 is set at such a level that the inner cap 2 never comes off the bottleneck 24 at the time of breakage and removal of the lid portion 13. Therefore, it is difficult for the attaching cylinder 3 to deform and widen largely in the radial direction. Because of this difficulty, the stop ridge 4 is prevented from climbing over the bottleneck-locking ridge 25, and as a result, the inner cap 2 is prevented from coming off the bottleneck.

In the meantime, when the bottle cap unit 1 is separately collected from the bottleneck 24, a wrenching force is applied manually on the inner cap 2 under the condition that the outer cap 15 has been screwed on the inner cap 2. Since the thickness of the attaching cylinder 3 is set at such a level that the inner cap 2 can be snapped out of the bottleneck 24, the attaching cylinder 3 bends and deforms fully in the radial direction. Thus, it is possible even for a weak person to snap the inner cap 2 easily out of the bottleneck 24.

When the bottle cap unit 1 is separately collected from the bottleneck 24, the inner cap 2, along with the outer cap 15 that has been screwed on the inner cap 2, may be forcibly snapped out of the bottleneck 24, as described above. However, as shown in FIG. 3 by a chain double-dotted line, the bottle cap unit 1 can be easily separated from the bottleneck 24 by inserting the tip of a hard tool near at hand, such as the periphery of a coin, into the gap between the attaching cylinder 3 and the neck ring 26 and prying the attaching cylinder 3 open with the coin in a manner to widen the diameter.

Second Embodiment

Figure 4:
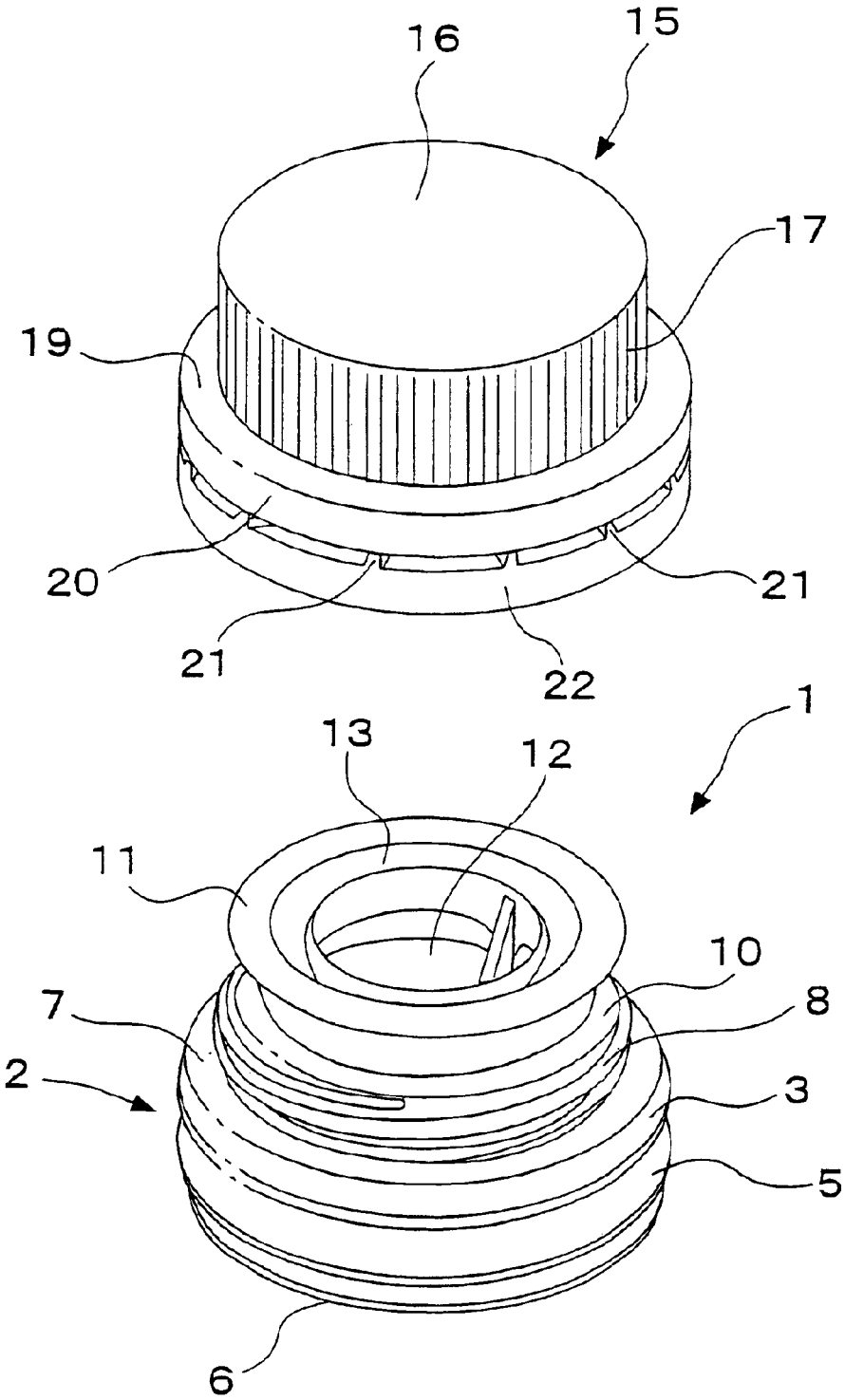
FIG. 4 is an entire perspective view showing the bottle cap unit in the second embodiment of this invention before the unit is assembled
Figure 5:
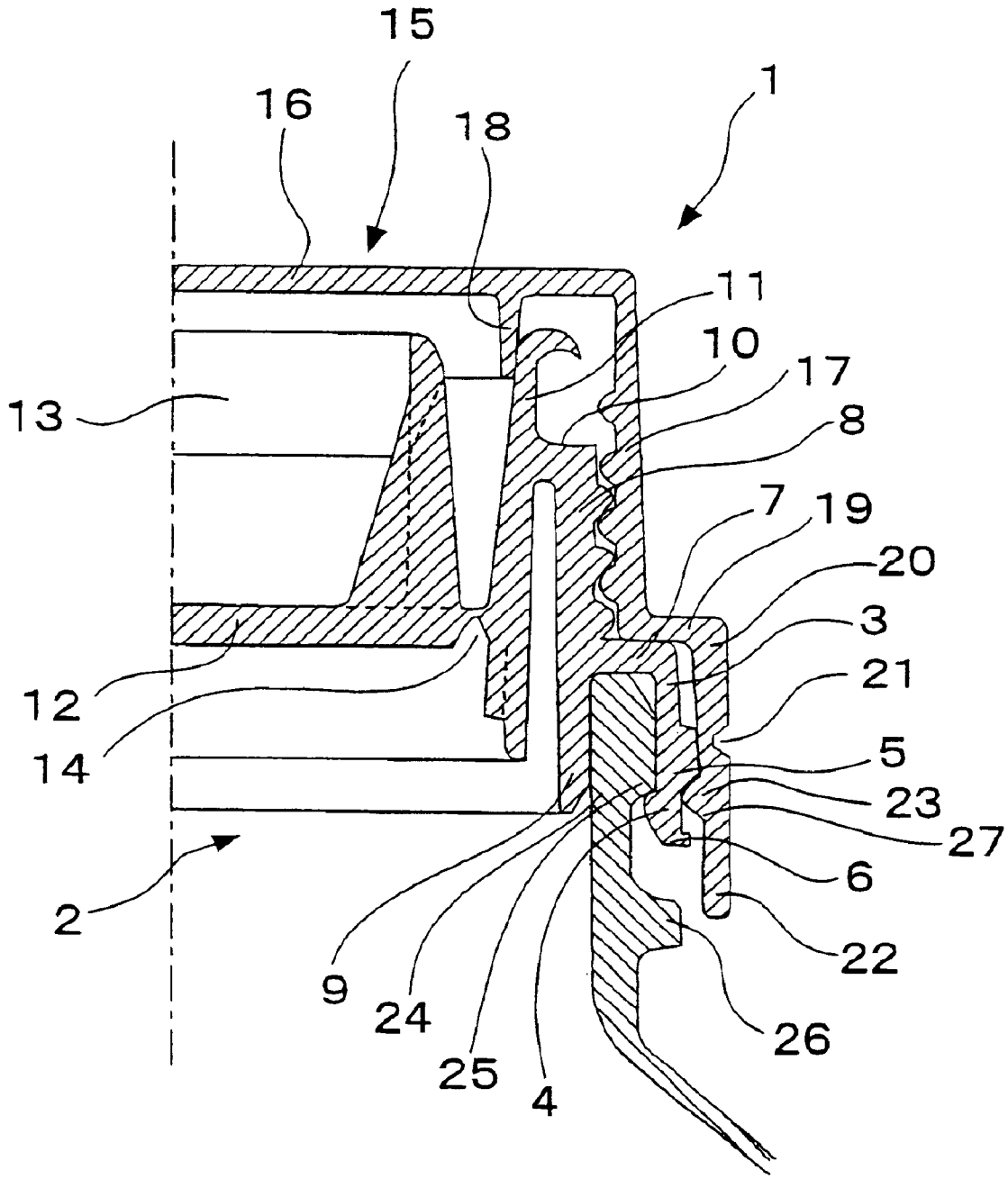
FIG. 5 is a partial, front elevational view showing the right half of the bottle cap unit in the second embodiment of FIG. 4 in a longitudinal section before the outer cap is screwed off.
Figure 6:
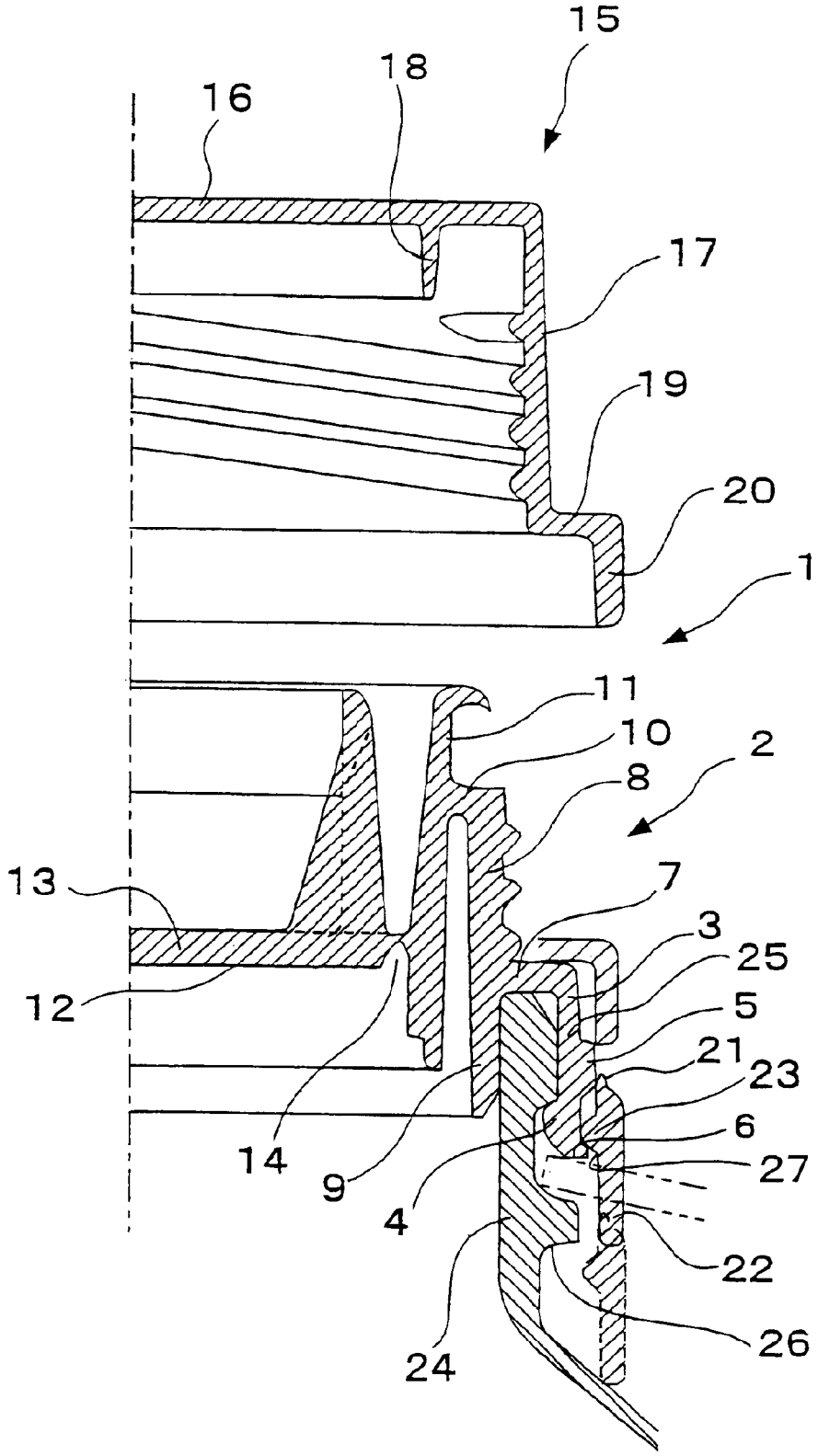
FIG. 6 is a partial, front elevational view showing the right half of the bottle cap unit in the second embodiment of FIG. 4 in a longitudinal section before the outer cap has been screwed off.

The second embodiment shown in FIGS. 4–6 includes the configuration of the first embodiment, and also comprises that this attaching cylinder 3 to be fitted around the bottleneck 24 is provided with a hooking edge 6, which is slightly projected laterally from the lower edge of the attaching cylinder 3 and is disposed in the lower portion of the first locking part 5 of a circumferential ridge structure.

The attachment of the inner cap 2 to the bottleneck 24 is set by means of the thickness of the attaching cylinder 3 at such a strength that the inner cap 2 can be manually snapped out of the bottleneck 24, and yet that strength is within a range enough to keep the inner cap 2 fitted tightly to the bottleneck 24 but not to allow the inner cap 2 to move freely around the neck.

The outer cap 15 has a configuration comprising:

- a top plate 16 from which a stopper guide 18 is suspended downward for tight fitting into the pour spout 11;
- a main cylinder 17, which is screwed on the threaded cylinder 8 and is suspended from the periphery of the top plate 16;
- an outer cylinder 20, which is beneath the main cylinder 17, is fitted around the attaching cylinder 3, and is suspended from the edge of the outward brim 19; and
- a locking cylinder 22, which is connected to the lower portion of this outer cylinder 20 through multiple, easy-to-break breaking pieces 21 and is provided with a circumferential ridge 27 serving as the ridge-like second locking part 23, which is disposed on the inner surface of this locking cylinder 22 and is engaged with the first locking part 5 by climbing it over and locking therewith from underside, with this second locking part 23 also having a light locking engagement from upper side with the hooking edge 6.

The width of the circumferential ridge 27, i.e., the second locking part 23, in the vertical direction is adequately smaller than the length between the first locking part 5 and the hooking edge 6. Thus, the locking cylinder 22 is allowed to fall as much as possible when the breaking pieces 21 are broken.

The locking cylinder 22 has a bore diameter larger than the outer diameter of the neck ring 26. In the unopened state shown in FIG. 2, the upper portion of the locking cylinder 22 comes in contact with the first locking part 5, and the lower edge faces the side of the neck ring 26. The locking cylinder 22 keeps back the attaching cylinder 3 from outside, and thereby prevents the attaching cylinder 3 from indiscriminate outward expansion and deformation, thus achieving and maintaining stable fitting of the inner cap 2 to the bottleneck 24.

When the breaking pieces 21 are broken, the locking cylinder 22 falls to the limit of fall, without interference of the neck ring 26, down to the position at which the locking cylinder 22 is stopped by the hooking edge 6, thus making sure that the locking cylinder 22 falls from the place where it has been before.

When the liquid content is to be poured out for the first time, the outer cap 15 is screwed off the inner cap 2 as shown in FIG. 6, and the pull ring is pulled up to break and remove the lid portion 13. At that time, the circumferential ridge 27 of the locking cylinder 22 is engaged with the hooking edge 6 and remains fitted around the attaching cylinder 3. Therefore, it is difficult for the attaching cylinder 3 to deform and widen largely in the radial direction. Because of this difficulty, the stop ridge 4 is prevented from climbing over the bottleneck-locking ridge 25.

The minimum bore diameter of the locking cylinder 22 including the second locking part 23 is set at a value larger than the outer diameter of the neck ring 26. Therefore, when the locking cylinder 22 leaves the attaching cylinder 3 downward, the locking cylinder 22 falls to the limit of fall, as shown in FIG. 6 by a chain double-dotted line, without interference of the neck ring 26, and can be separated without fail from the attaching cylinder 3.

Thus, the attaching cylinder 3 has such a thickness that the inner cap 2 can be snapped out of the bottleneck 24 manually. Expansion and deformation can take place under a manual wrenching force in the lower portion of the attaching cylinder 3, without interference of the locking cylinder 22. Therefore, it is possible even for a weak person to snap the inner cap 2 easily out of the bottleneck 24.

Similarly, when the locking cylinder 22 falls down to the limit of fall without interference of the neck ring 26, a gap is exposed between the neck ring 26 and the lower edge of the attaching cylinder 3. As shown in FIG. 6 by a chain double-dotted line, the bottle cap unit 1 can be easily separated by inserting the tip of a hard tool near at hand, such as the periphery of a coin, into the gap and wrenching the attaching cylinder 3 open in the radial direction.

Third Embodiment

Figure 7:
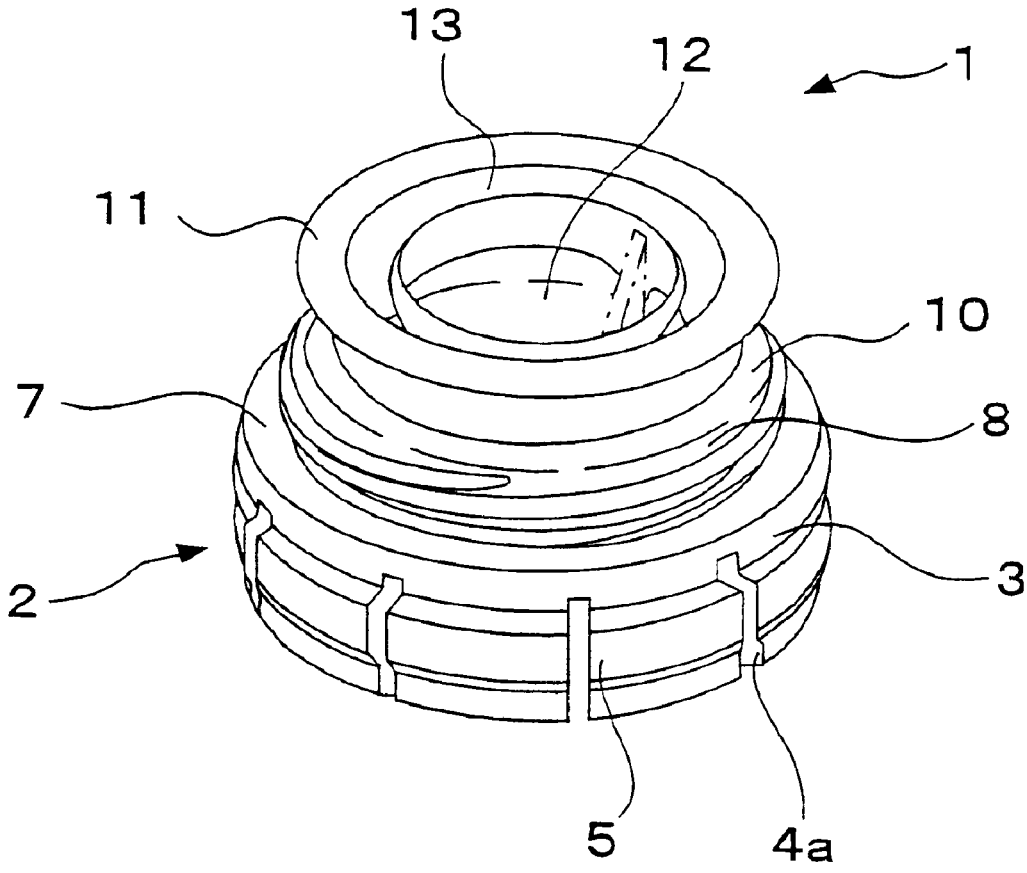
FIG. 7 is an entire perspective view showing the inner cap in the third embodiment of this invention.
Figure 8:
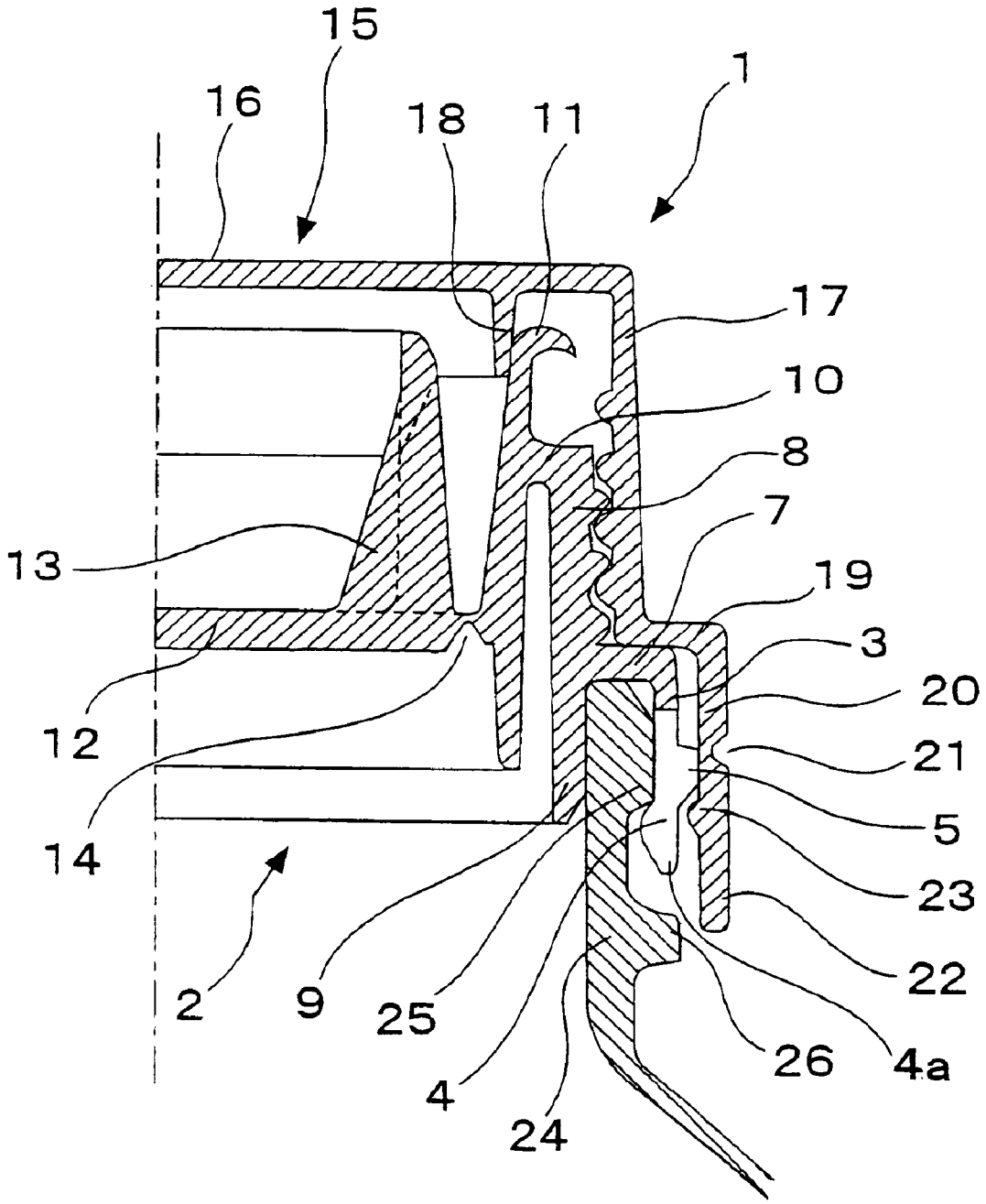
FIG. 8 is a partial, front elevational view showing the right half of the inner cap in the third embodiment of FIG. 7 in a longitudinal section.

The third embodiment shown in FIGS. 7 and 8 has a configuration that the strength of attachment of the inner cap 2 to the bottleneck 24 is set by the expanding slots 4*a*, which are disposed in the lower portion of the attaching cylinder 3 of the inner cap 2. The first locking part 5 of the inner cap 2 has an intermittent, circumferential ridge structure because of the expanding slots 4*a*. In forming the expanding slots 4*a*, it is necessary to design the slots while giving consideration to the number, length, and width of the slots, as well as the entire bottle structure and the bottle usage. This is because the attachment of the inner cap 2 to the bottleneck 24 has to be set at a proper strength and because the strength has to be within a range enough to be able to snap the inner cap 2 out of the bottleneck 24 by applying only a weak-wrenching force.

When the bottle cap unit 1 is separated and collected from the bottleneck 24, a wrenching force is applied manually on the inner cap 2 under the condition that the outer cap 15 has been screwed on the inner cap 2. In the presence of the expanding slots 4*a*, only a weak-wrenching force is enough for the attaching cylinder 3 to bend and deform fully in the radial direction so that even a weak person can snap the bottle cap unit 1 easily out of the bottleneck 24.

Fourth Embodiment

Figure 9:
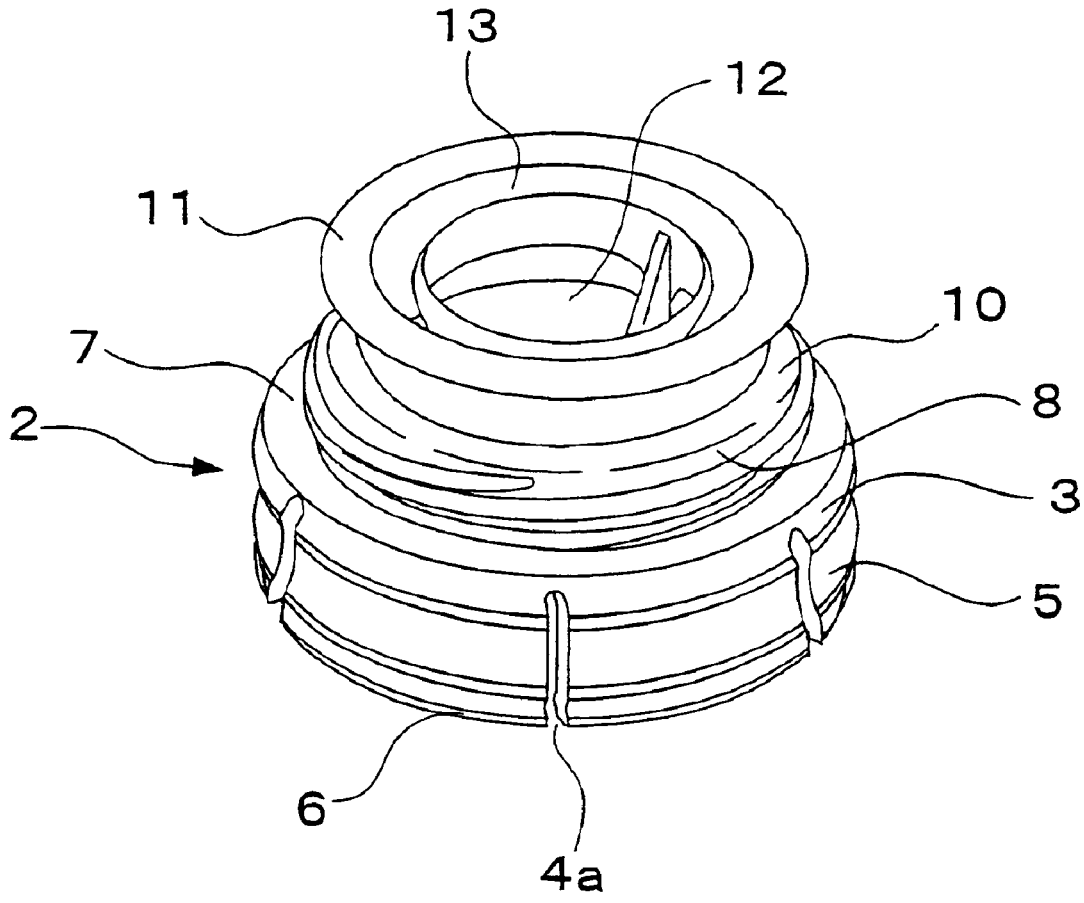
FIG. 9 is an entire perspective view showing the inner cap in the fourth embodiment of this invention.
Figure 10:
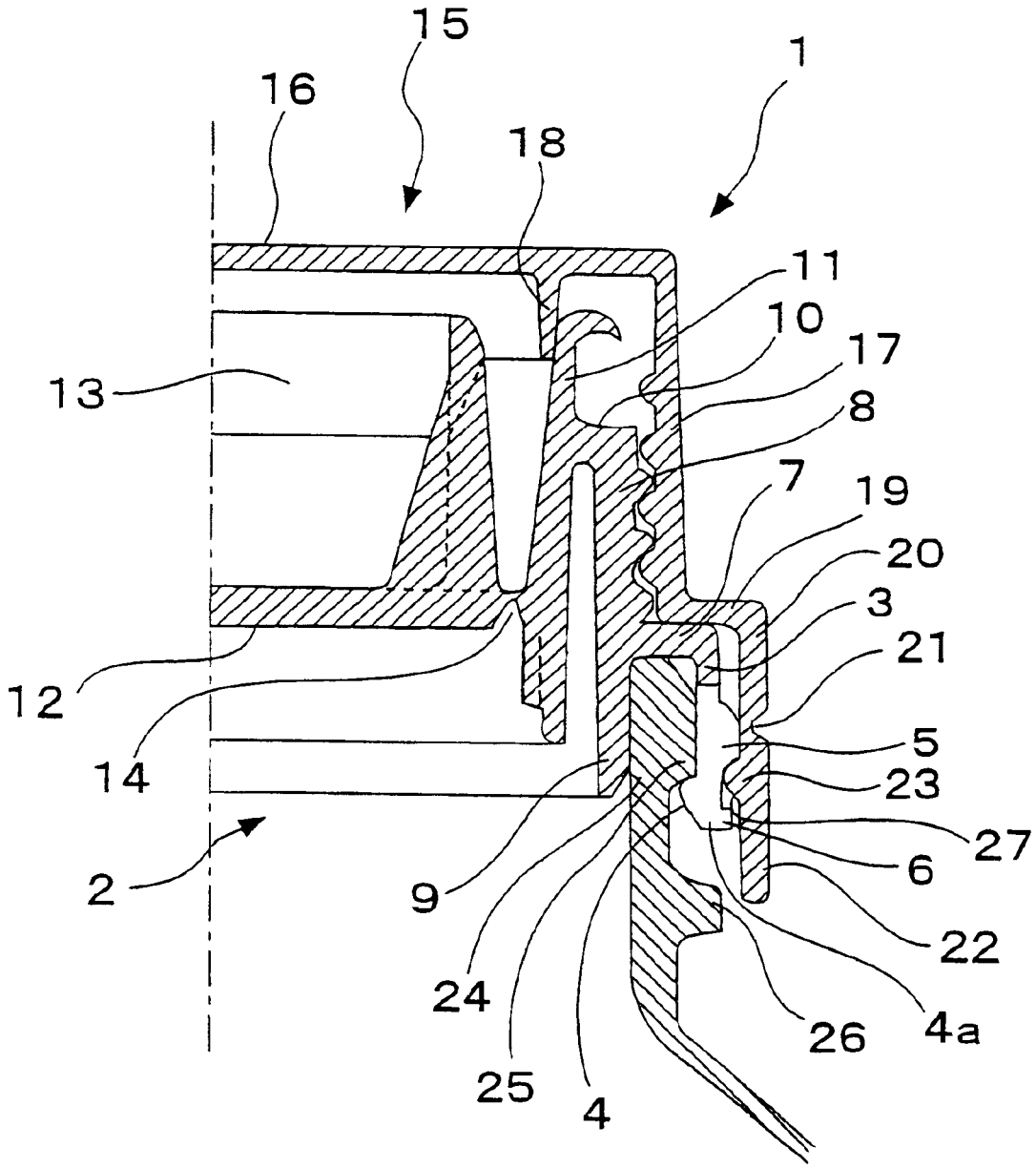
FIG. 10 is a partial, front elevational view showing the right half of the bottle cap unit in the fourth embodiment of FIG. 9 in a longitudinal section before the outer cap is screwed off.

The fourth embodiment shown in FIGS. 9 and 10 has a configuration that the strength at which the inner cap 2 provided with the hook edge 6 is attached to the bottleneck 24 is set by means of the expanding slots 4*a* disposed at least in the lower portion of the attaching cylinder 3.

When the bottle cap unit 1 is separated and collected from the bottleneck 24, only a weak-wrenching force is enough for the attaching cylinder 3 to bend and deform fully in the radial direction in the presence of the expanding slots 4*a*. Therefore, the bottle cap unit 1 can be easily snapped out of the bottleneck 24 for separate collection.

Fifth Embodiment

Figure 11:
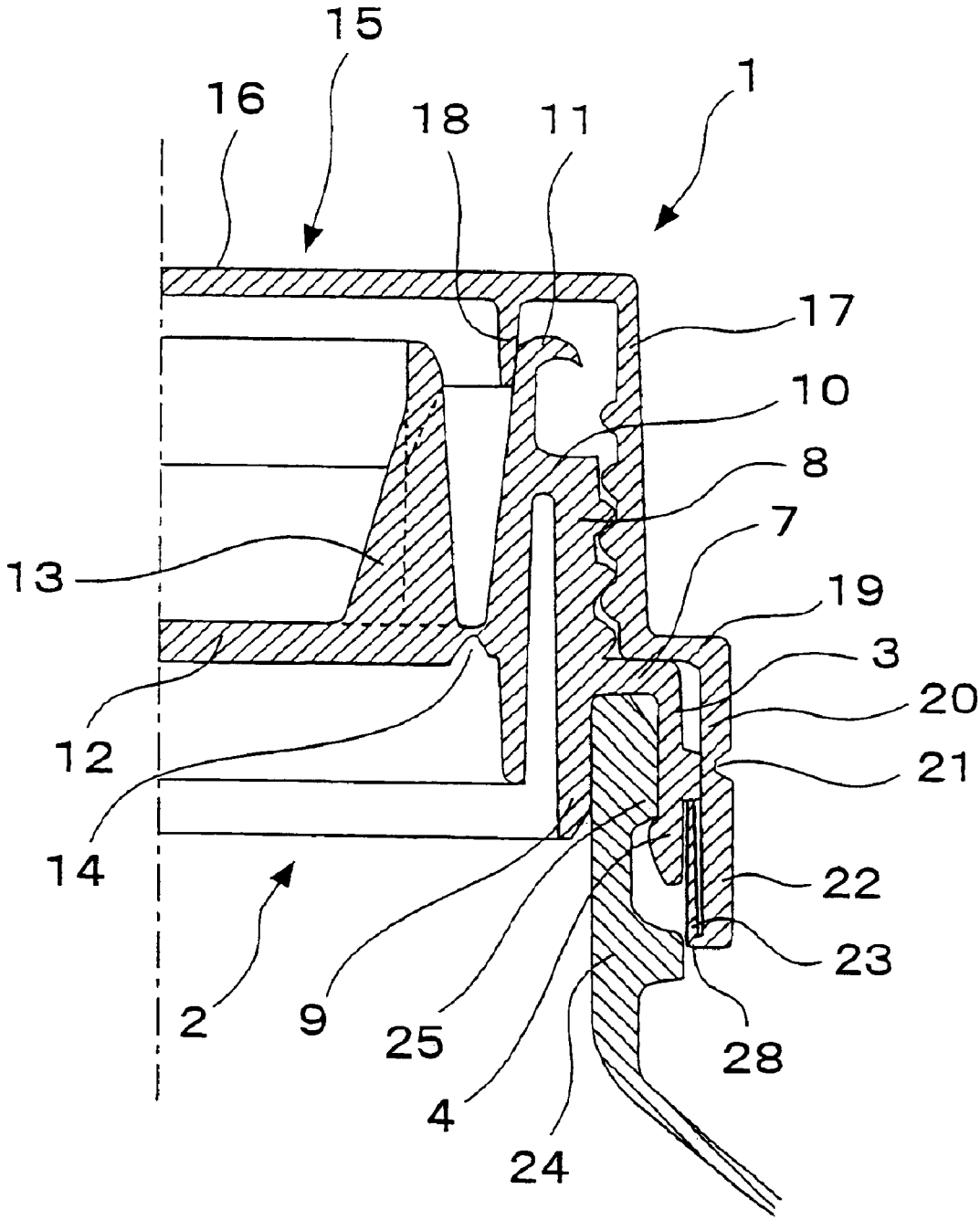
FIG. 11 is a partial, front elevational view showing the right half of the bottle cap unit in the fifth embodiment of this invention in a longitudinal section before the outer cap is screwed off.
Figure 12:
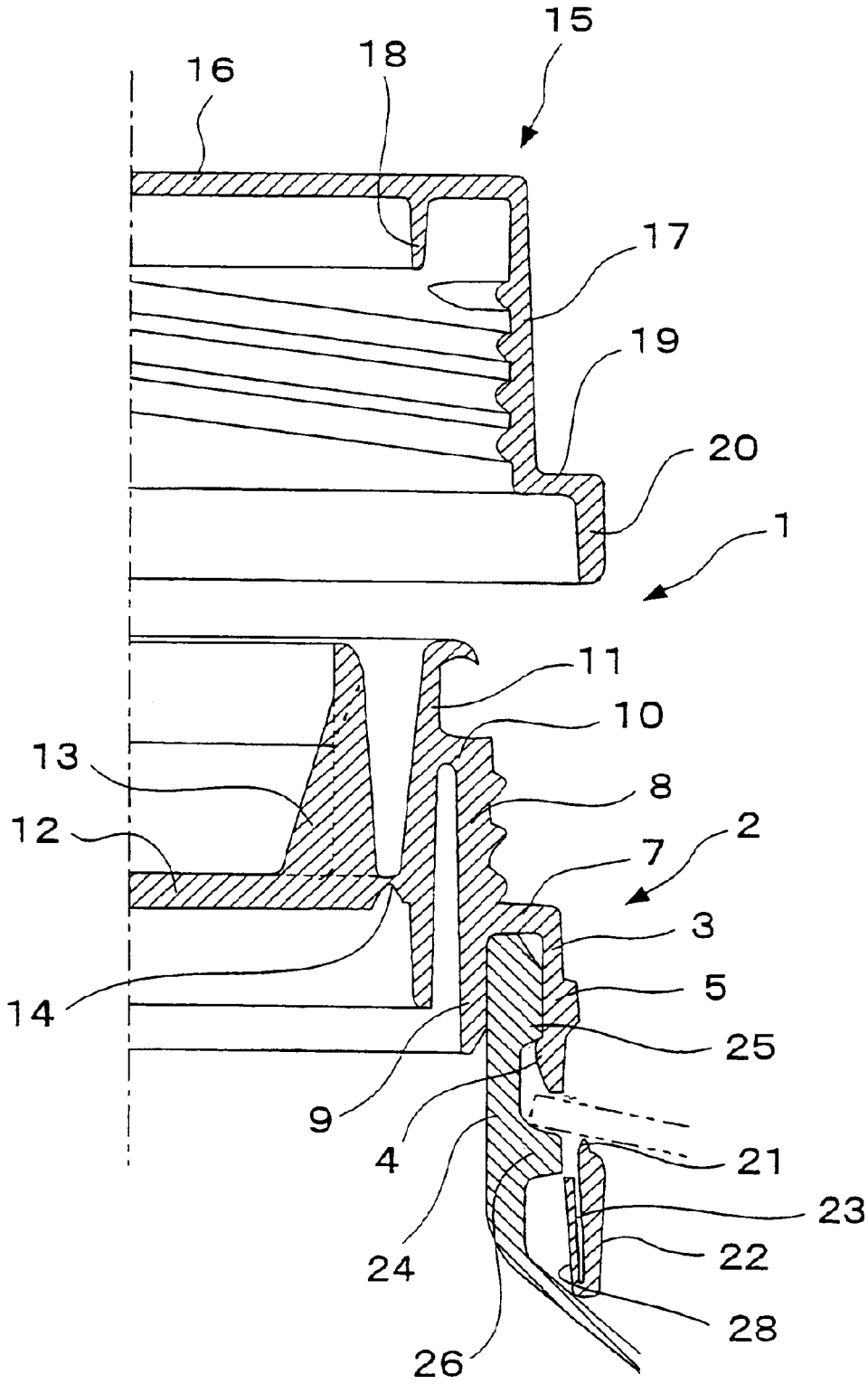
FIG. 12 is a partial, front elevational view showing the right half of the bottle cap unit in the fifth embodiment of this invention in a longitudinal section before the outer cap has been screwed off.

In the fifth embodiment shown in FIGS. 11 and 12, the second locking part is disposed on the locking cylinder 22 of the outer cap 15, and consists of multiple, flexible flaps 28, which can be extended obliquely upward and inward from the lower edge of the locking cylinder 22.

The flexible flaps 28 are obtained by cutting out the lower portion of the locking cylinder 22 to form multiple sections, which are bent inward into flaps at the height of the neck ring 26 so that the flaps 28 extend obliquely upward. The flexible flaps 28 may also be multiple projections extending obliquely upward from the lower edge of inner surface of the locking cylinder 22.

When the outer cap 15 is fitted to the inner cap 2, the flexible flaps 28 are displaced as shown in FIG. 11. These flaps 28 climb over the first locking part 5 smoothly without breaking the multiple, easy-to-break, breaking pieces 21 connected to the locking cylinder 22 so that the outer cap 15 can be screwed on the inner cap 2.

When the bottle cap unit 1 is opened for the first time, the flexible flaps 28 locks together with the first locking part 5 from underside without fail, and prevents the locking cylinder 22 from going upward. As shown in FIG. 12, the breaking pieces are surely broken, and the locking cylinder 22 falls in a reliable way without being interfered by the neck ring 26.

Sixth Embodiment

Figure 13:
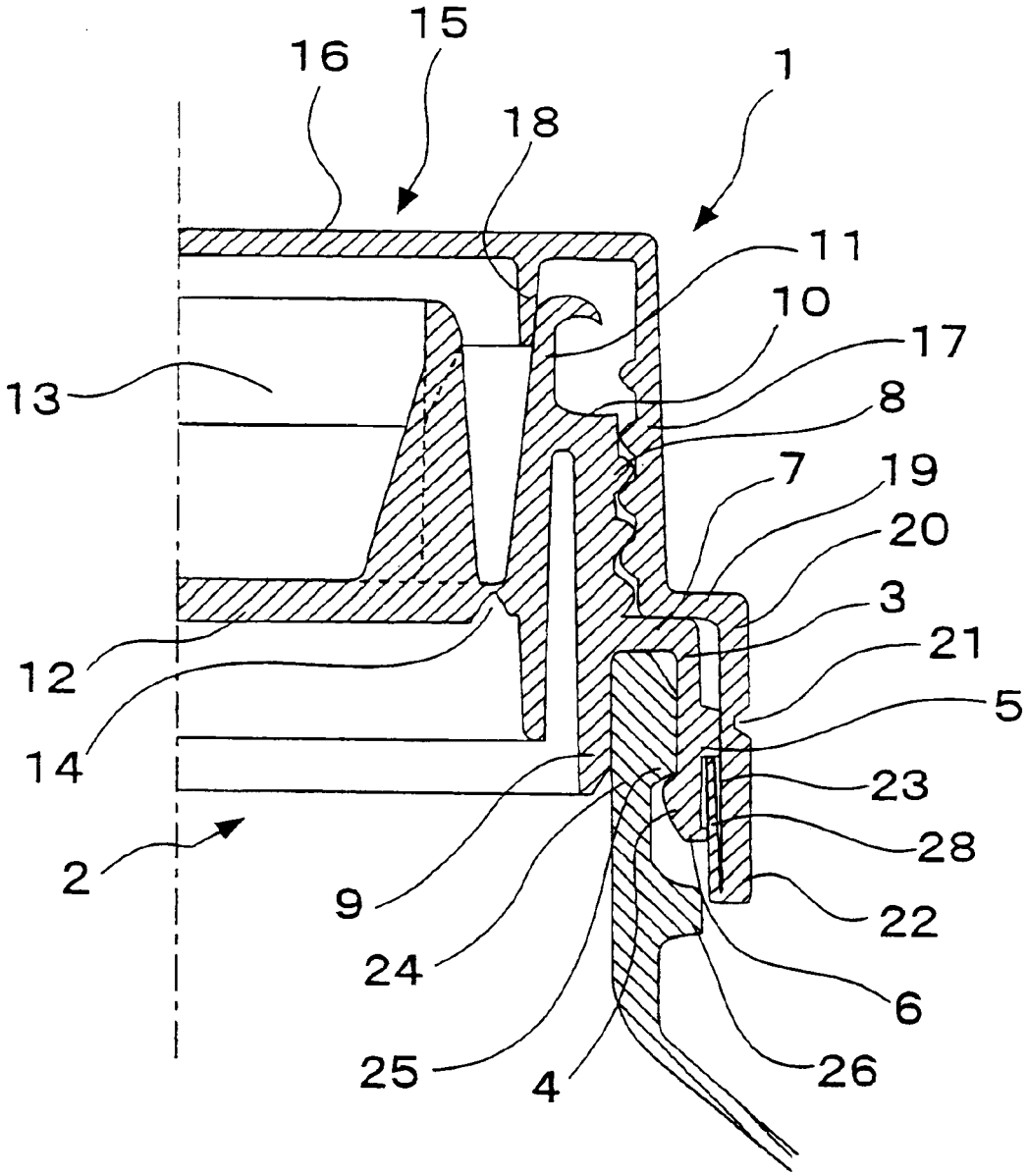
FIG. 13 is a partial, front elevational view showing the right half of the bottle cap unit in the sixth embodiment of this invention in a longitudinal section before the outer cap is screwed off.
Figure 14:
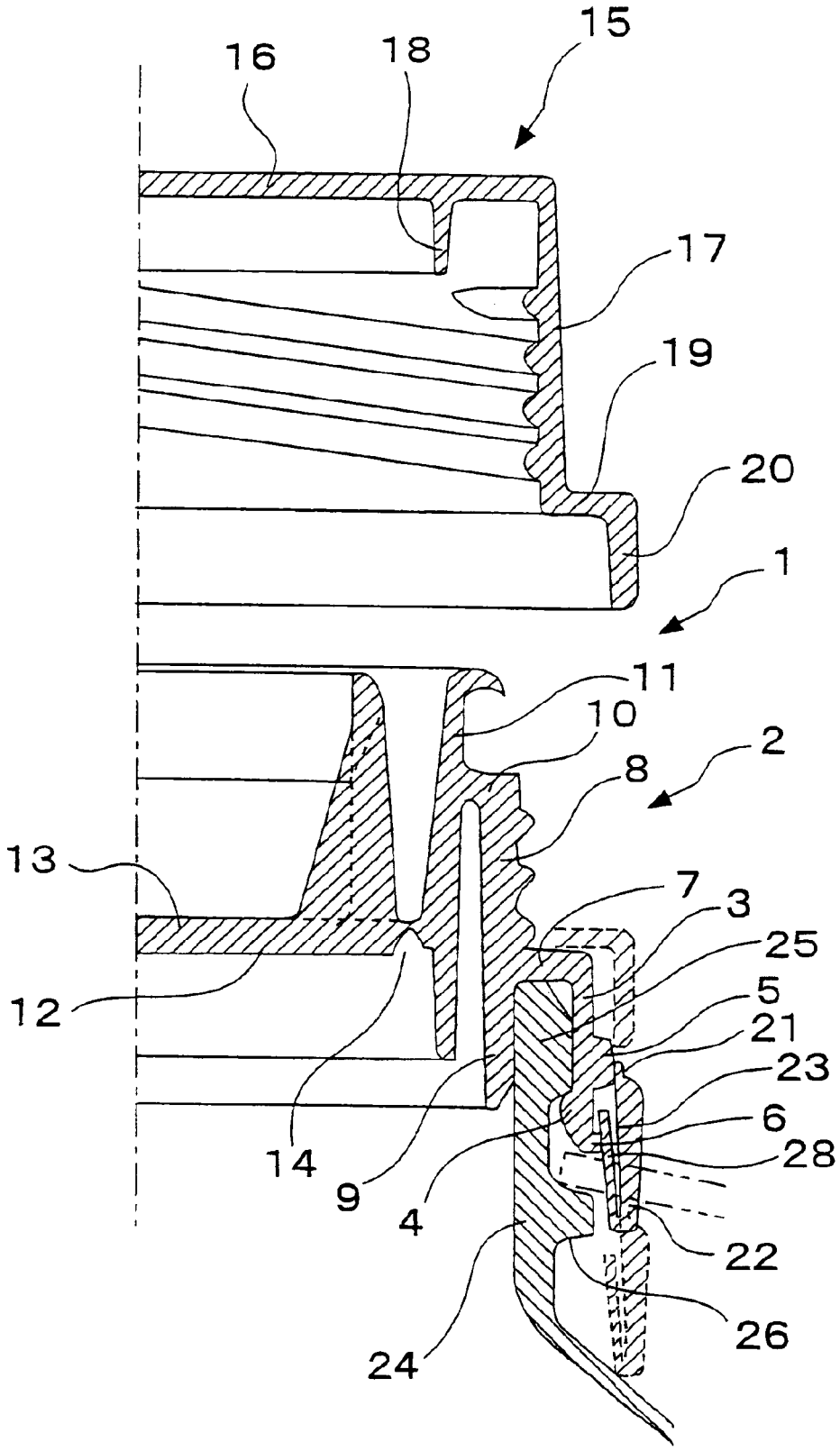
FIG. 14 is a partial, front elevational view showing the right half of the bottle cap unit in the sixth embodiment of FIG. 13 in a longitudinal section before the outer cap has been screwed off.

In the sixth embodiment shown in FIGS. 13 and 14, the second locking part is disposed on the locking cylinder 22 of the outer cap 15, and consists of multiple, flexible flaps 28, which can be extended obliquely upward and inward from the lower edge of the locking cylinder 22.

As shown in FIG. 13, when the outer cap 15 is screwed on the inner cap 2 provided with the hooking edge 6 in the lower, outer portion of the attaching cylinder 3, the flexible flaps 28 change their positions flexibly, climb over the first locking part 5 easily, and allow the outer cap 15 to be screwed on the inner cap 2.

When the breaking pieces 21 are broken as shown in FIG. 14, the flaps 28 securely lock with the first locking part 5 from underside to prevent the locking cylinder 22 from ascending. The breaking pieces 21 are thus broken without fail, and the locking cylinder 22 falls without interference of the neck ring 26 down to the position at which the locking cylinder 22 is stopped by the hooking edge 6. At that position, the locking cylinder 22 holds back the attaching cylinder 3 from outside and helps the inner cap 2 remaining fitted stably onto the bottleneck 24. At the same time, the locking cylinder 22 covers the gap formed between the attaching cylinder 3 and the neck ring 26, and thereby makes it impossible to pick the inner cap 2 unjustly out of the bottleneck.

When the bottle cap unit 1 is removed from the bottleneck 24 for separate collection, a pulling force is acted on the locking cylinder 22 in the downward direction, as shown in FIG. 14 by a chain double-dotted line, to release the flexible flaps 28 from the weak engagement with the hooking edge 6 and to allow the locking cylinder 22 to fall down to the limit of fall. Then, the bottle cap unit can be snapped out of the bottleneck 24 by grasping the inner cap 2 with a hand and wrenching it away.

Industrial Availability

As described above, this invention makes it impossible to pick the synthetic resin bottle cap unit unjustly out of the bottleneck, and enables the synthetic resin bottle cap unit to be snapped easily out of the bottleneck for separate collection.

What is claimed is:

1. A synthetic resin bottle cap unit comprising an inner cap having an attaching cylinder which is tightly fitted around bottleneck and is locked by climbing over the neck to form a pour spout, and a cylindrical, flat-topped outer cap, which is detachably screwed on or off the inner cap to close or open the pour spout, said attaching cylinder of the inner cap being provided with the first locking part disposed on outer cylindrical wall of the portion opposed to the locking part of the bottleneck, and said outer cap being provided with an outer cylinder, which is fitted around the attaching cylinder under the closed state, and being provided with a locking cylinder disposed in the lower portion of the outer cylinder and integrally connected thereto through multiple breaking pieces, said locking cylinder having a bore diameter larger than the outer diameter of neck ring and having the second locking part that goes into the locking engagement from underside with the first locking part, wherein the attachment of the inner cap to the bottleneck is set at such a strength that the inner cup can be manually snapped out of the bottleneck, and yet said strength being within a range enough to keep the inner cap fitted tightly to the bottleneck but not to allow the inner cap to be slipped out of the bottleneck because of a water-hammer force of the liquid content nor to allow the inner cap to move freely around the neck.

2. A synthetic resin bottle cap unit, comprising an inner cap having an attaching cylinder, which is tightly fitted around bottleneck end is locked by climbing over the neck to form a pour spout, and a cylindrical, flat-topped outer cap, which is detachably screwed on or off the inner cap to close or open the pour spout, said attaching cylinder of the inner cap being provided with the first locking part disposed on outer cylindrical wall of the portion opposed to the locking part of the bottleneck and also being provided with a hooking edge slightly projected laterally from the lower edge of the attaching cylinder, and said outer cap being provided with an outer cylinder, which is fitted around the attaching cylinder under the closed state, and with a locking cylinder disposed in the lower portion of the outer cylinder and integrally connected thereto through multiple breaking pieces, said locking cylinder having a bore diameter larger than the outer diameter of this neck ring and having the second locking part that goes into a tight locking engagement from underside with the first locking part and into a light locking engagement from upper side with the hooking edge, wherein the attachment of the inner cap to the bottleneck is set at such a strength that the inner cap can be manually snapped out of the bottleneck, and yet said strength being within a range enough to keep the inner cap fitted tightly to the bottleneck but not to allow the inner cap to move freely around the neck.

3. The synthetic resin bottle cap unit according to claim 1, wherein the strength of attachment of the inner cap to the bottleneck is set by means of the thickness of the attaching cylinder.

4. The synthetic resin bottle cap unit according to claim 1, wherein the strength of attachment of the inner cap to the bottleneck is set by means of expanding slots disposed at least in the lower portion of the attaching cylinder.

5. The synthetic resin bottle cap unit according to claim 1, wherein the locking cylinder of the outer cap has a height ranging from the level of the first locking part to the neck ring of the bottleneck.

6. The synthetic resin bottle cap unit according to claim 1, wherein the first locking part has a simple ridge structure.

7. The synthetic resin bottle cap unit according to claim 1, wherein the second locking part is a circumferential ridge, which is disposed on the inner surface of the locking cylinder and is capable of climbing over the first locking part.

8. The synthetic resin bottle cap unit according to claim 1, wherein either or both of the first locking part and the second locking part have an intermittent, circumferential ridge structure.

9. The synthetic resin bottle cap unit according to claim 1, wherein the second locking part consists of multiple, flexible flaps, which are capable of elastic displacement to extend obliquely upward and inward from the lower edge of the locking cylinder.

10. The synthetic resin bottle cap unit according to claim 1, wherein a space enabling the periphery of a coin to enter therein is formed between the neck ring and the lower edge of the attaching cylinder.

11. The synthetic resin bottle cap unit according to claim 1, wherein the minimum bore diameter of the locking cylinder including the second locking part is set at a value larger than the outer diameter of the neck ring.

12. The synthetic resin bottle cap unit according to claim 1, wherein the inner cap is colored differently from the outer cap.

13. The synthetic resin bottle cap unit according to claim 1, wherein the pour spout of a pull-open type is formed in the inner cap to guide the flow of the liquid content and is opened by pulling up a pull ring and the like to break open a lid portion zoned by a breaking groove that forms a closed loop surrounding a sealing lid, which is the bottom of the pour spout.

* * * * *